US006983677B1

(12) United States Patent
Engel

(10) Patent No.: US 6,983,677 B1
(45) Date of Patent: Jan. 10, 2006

(54) SWITCHING MECHANISM FOR CONVERTIBLE RETAINING RING PLIERS

(75) Inventor: Bruce J. Engel, Milwaukee, WI (US)

(73) Assignee: A&E Incorporated, Racine, WI (US)

( * ) Notice: Subject to any disclaimer, the term of this patent is extended or adjusted under 35 U.S.C. 154(b) by 0 days.

(21) Appl. No.: 10/818,251

(22) Filed: Apr. 5, 2004

(51) Int. Cl.
*B25B 7/12* (2006.01)

(52) U.S. Cl. ..... 81/302; 81/486; 29/229

(58) Field of Classification Search ..... 81/302, 81/300, 385–387, 415–416, 485, 486; 29/225, 29/229, 268
See application file for complete search history.

(56) References Cited

U.S. PATENT DOCUMENTS

| | | | | |
|---|---|---|---|---|
| 3,995,360 | A | 12/1976 | Millheiser | |
| 4,172,523 | A | 10/1979 | Weglage | |
| 4,280,265 | A | 7/1981 | Murphy | |
| 4,476,750 | A | 10/1984 | Murphy | |
| 4,621,401 | A | 11/1986 | Anderson | |
| 4,625,379 | A | 12/1986 | Anderson | |
| 4,702,001 | A | 10/1987 | Malm et al. | |
| 4,790,056 | A | 12/1988 | Anderson | |
| 4,862,572 | A | 9/1989 | Jeromson, Jr. et al. | |
| 5,007,313 | A | 4/1991 | Jeromson, Jr. et al. | |
| 5,079,977 | A | 1/1992 | Petrie | |
| 5,174,177 | A | 12/1992 | Jeromson, Jr. et al. | |
| 5,542,167 | A * | 8/1996 | Nakamoto | 29/229 |
| 5,826,467 | A | 10/1998 | Huang | |
| 5,865,075 | A | 2/1999 | Medved | |
| 6,145,417 | A | 11/2000 | Bates et al. | |
| 6,249,946 | B1 | 6/2001 | Greenhill | |
| 6,378,403 | B1 | 4/2002 | Bates et al. | |
| 6,470,774 | B2 * | 10/2002 | Chang | 81/302 |

* cited by examiner

*Primary Examiner*—Debra S Meislin
(74) *Attorney, Agent, or Firm*—Andrus, Sceales, Starke & Sawall, LLP

(57) ABSTRACT

A convertible retaining ring pliers has a pivot, first and second jaws and first and second handles rotatably secured about the pivot. A pair of transfer pins is slidably disposed for selective movement in the first and second jaws and the first and second handles for establishing alternative operating positions enabling the jaws to move inwardly as the handles move inwardly and allowing the jaws to move outwardly as the handles inwardly. A switching mechanism is mounted to the handles and pivot for providing simultaneous shifting of the transfer pins in the jaws of the handles. The switching mechanism includes first and second flexing spring plates which are mounted on opposite ends of the pivot and disposed on opposite external surfaces of the handles. Each of the spring plates includes a pair of boss pins engageable with opposite ends of the transfer pins. In each operating position, one pair of corresponding boss pins on the first and second spring plates lie raised above the external surfaces of the handles, and another pair of corresponding boss pins lie recessed in the first and second handles.

12 Claims, 6 Drawing Sheets

SWITCHING MECHANISM FOR CONVERTIBLE RETAINING RING PLIERS

FIELD OF THE INVENTION

The present invention relates broadly to retaining ring pliers used to remove and replace both internal and external retaining rings. Such pliers are convertible between a first position which allows the jaws to move inwardly as the handles are moved inwardly, and a second position which enables the jaws to move outwardly as the handles are moved inwardly. More particularly, the invention relates to a switching mechanism provided on the retaining ring pliers to more easily effect the transfer between the first and second positions.

BACKGROUND OF THE INVENTION

Retaining rings are utilized in annular grooves on shafts and ends of shafts to retain bearings, collars, and the like on the shaft. A retaining ring extends circumferentially between a pair of ends which have hubs. The hubs have apertures that receive tips of a plier tool. The force applied by the pliers either spreads the hubs to expand the ring or squeezes the hubs to contract the ring. The plier tool is necessary for installing the retaining ring in and removing the retaining ring from either external or internal grooves.

Accordingly, it is sometimes desirable to squeeze the handles to effect movement of the jaws outwardly to expand the ring. It is at other times desirable to squeeze the handles to effect movement of the jaws inwardly to contract the ring. Thus, it is desirable to provide a pliers that is convertible between an external and an internal tool. U.S. Pat. Nos. 4,280,265 and 4,476,750 disclose a pair of retaining ring pliers that utilize a pair of separate coplanar jaws and a pair of separate handles that range about a common fixed pivot point and that are adapted to be changed to alternately engage one handle to one jaw and the other handle to the other jaw and vice versa to permit the changing of the tool from external to internal. Two fulcrum or transfer pins of a latching arrangement are disposed in the jaws and are adapted to alternately engage each set of the handles to shift from a position adapted to move the jaws inwardly as the handles are moved inwardly, to a position where the jaws are moved outwardly as the handles are moved inwardly.

The prior art retaining ring pliers in the '265 and '750 patents require that a user have a dull pointed instrument, such as a pen, nail or screwdriver, handy to forcefully push the pins between their alternate positions. Specifically, the user would have to squeeze the handles of the pliers inwardly to align the transfer pins of the latching arrangement with holes formed in the handles, and then use the pointed instrument to push the pins from each respective side of the pliers. Thus, each of the transfer pins disclosed in the above-noted patents has to be independently placed in the correct position using an additional tool.

Accordingly, it is desirable to provide a convertible retaining ring pliers that does not require another instrument or tool to convert the pliers from internal to external mode and vice versa. It is further desirable to provide a relatively simple switching mechanism which will enable finger pressure to be simultaneously applied to the transfer pins from each side of the pliers, while the handles are moved inwardly to align the transfer pins with the proper holes in the jaws. It is intended that the simultaneous movement of the transfer pins will make the conversion faster than previous models with far less complexity required in the plier structure.

SUMMARY OF THE INVENTION

It is one object of the present invention to provide a switching mechanism in a convertible retaining ring pliers for selectively and alternatively joining relative moveable external members to a common internal member in a more efficient manner.

It is also an object of the present invention to provide a switching mechanism in a retaining ring pliers for enabling simultaneous shifting of the transfer pins.

It is a further object of the present invention to provide a switching mechanism in a retaining ring pliers which provides a user with an enhanced visual indication of the operating position of the pliers.

It is an additional object of the present invention to provide a switching mechanism in a retaining ring pliers wherein the mechanism includes a pair of switches which flex to allow the simultaneous shifting of the transfer pins and hold the transfer pins in their desired operating positions.

Another object of the present invention is to provide a retaining ring pliers switching mechanism which has a minimum of parts and is simple to assemble and operate.

In one aspect of the invention, a retaining ring pliers includes a pivot assembly and first and second jaws arranged for oscillation toward and away from each other about the pivot assembly. The handles have portions adjacent to the pivot assembly disposed on respective opposite sides of the jaws. A transfer pin is slidably disposed in each jaw for alternative engagement with one or the other of the handle portions. The transfer pins are disposed in transverse bores in the jaws having axes parallel to the axis of the pivot assembly. Each of the handle portions has a pair of spaced holes disposed to receive the transfer pins. The transfer pins in the first and second jaws are selectively slidably engaged in the holes of respective first and second handles to effect movement of the jaws towards each other when the handles are moved towards each other to define a first operating position. The transfer pins in the first and second jaws are selectively slidably engaged in the holes of respective second and first handles to effect movement of the jaws away from each other as the handles are moved toward each other to define a second operating position. The pliers is improved by means of a switching mechanism mounted to the pivot assembly and in contact with external surfaces of the handle portions and the transfer pins for enabling simultaneous shifting of the transfer pins in the first and second jaws and holes of the first and second handles. The switching mechanism includes a first flexing spring plate disposed on the external surface of one handle portion, and a second flexing spring plate disposed on the external surface of the other handle portion. Each of the spring plates has a pair of boss pins engageable with opposite ends of the transfer pins.

Each spring plate has an external arcuate-shaped portion integrally joined by a connecting segment to an internal, circular anchoring portion. The external portion, the connecting segment and the internal portion are all substantially coplanar. The external portion has a pair of curved arms held spaced apart from the internal portion. An outer end of each curved arm is provided with one of the boss pins. The internal portion of the first spring plate is anchored to one end of the pivot assembly, and the internal portion of the second spring plate is joined to an opposite end of the pivot assembly. In each spring plate, each curved arm is temporarily deformable about a fulcrum point defined by the connecting segment. For a given operating position, one pair of corresponding boss pins on the first and second spring plates lie raised above the external surfaces of the handle portions, and another pair of corresponding boss pins lie recessed in holes of the first and second handles. Each boss pin lies between an underside of one of the curved arms and an outermost end of the transfer pins. In each operating position, one of the curved arms of each spring plate lies flush against the external surface of one of the handles, and the other of the curved arms of the spring plate is temporarily bent upwardly relative to the external surface of the handle.

In another aspect of the invention, a convertible retaining ring pliers includes a pivot, and first and second jaws as well as first and second handles rotatably joined about the pivot. A pair of transfer pins is slidably disposed for selective movement in the first and second jaws and the first and second handles for establishing a first operating position enabling the jaws to move inwardly as the handles move inwardly, and a second operating position allowing the jaws to move outwardly as the handles move inwardly. A switching mechanism is mounted to the handles at the pivot for providing simultaneous shifting of the transfer pins in the jaws of the handles between the first and second operating positions. The switching mechanism includes a first flexing spring plate mounted to one end of the pivot and disposed on an external surface of the first handle, and a second flexing spring plate mounted to an opposite end of the pivot and disposed on an external surface of the second handle. Each of the spring plates has a pair of boss pins engageable with opposite ends of the transfer pins. In each operating position, one pair of corresponding boss pins on the first and second spring plates lie raised above the external surfaces of the handles, and another pair of corresponding boss pins lies recessed in the first and second handles.

The invention further contemplates a method of converting a retaining ring pliers having a pivot, first and second jaws rotatably secured to the pivot, first and second handles rotatably joined about the pivot, and a pair of transfer pins slidably disposed for selective movement in the first and second jaws and the first and second handles between one operating position enabling the jaws to move inwardly as the handles move inwardly, and a second operating position enabling the jaws to move outwardly as the handles move inwardly. The method includes the steps of mounting a first flexing spring plate having a first pair of boss pins at opposite ends thereof to one end of the pivot such that the first spring plate is disposed on an external surface and the first pair of boss pins are engageable with opposite ends of the transfer pin; mounting a second flexing spring plate having a second pair of boss pins at opposite ends thereof to an opposite end of the pivot such that the second spring plate is disposed on an external surface of the second handle and the second pair of boss pins are engageable with opposite ends of the transfer pins. In each operating position, one pair of corresponding boss pins on the first and second spring plates lie raised above the external surfaces of the handles, and another pair of corresponding boss pins lie recessed in the first and second handles. Finger pressure is applied to ends of the spring plates carrying the raised boss pins to simultaneously shift the transfer pins between the first and second operating positions.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
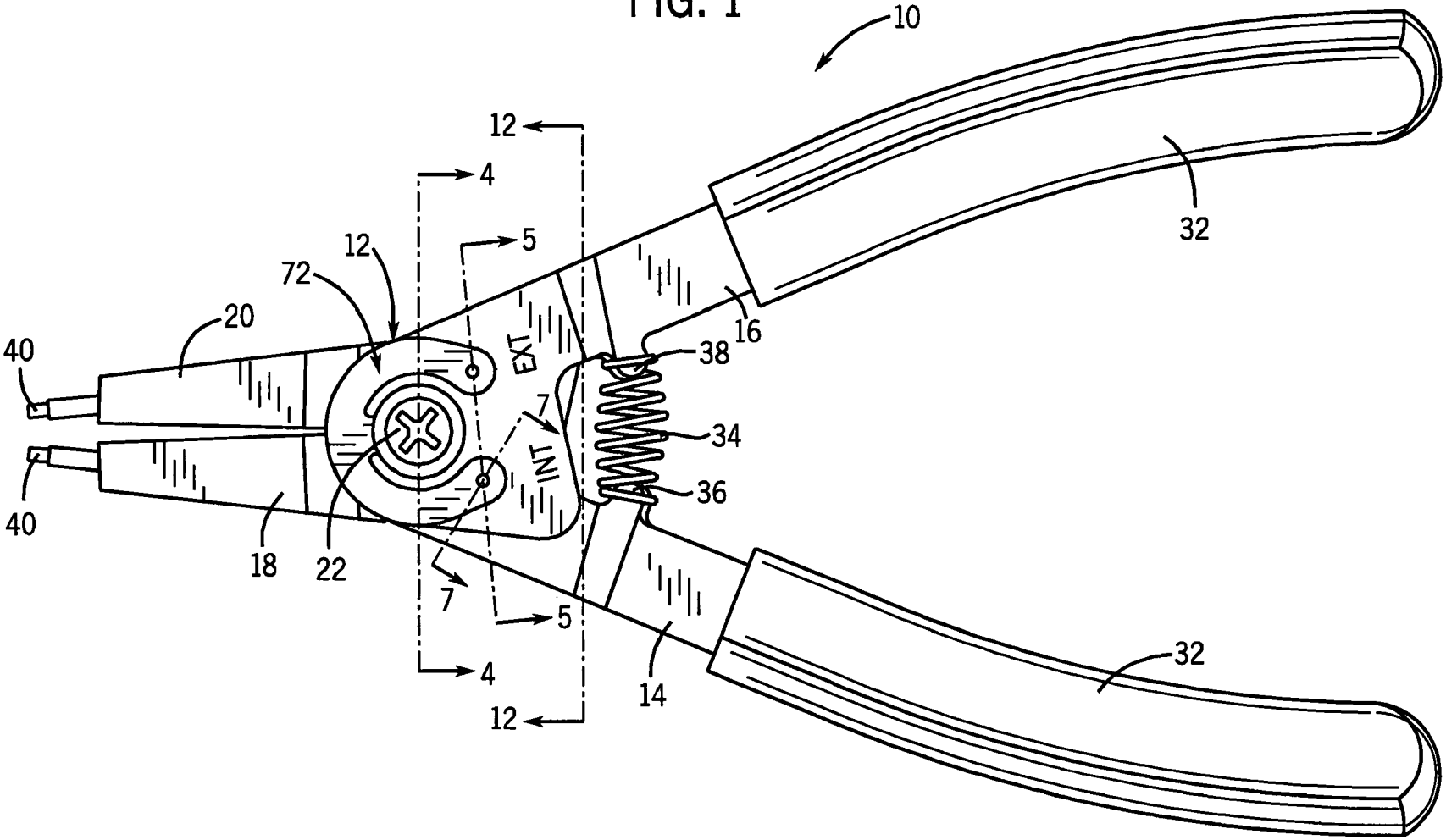
FIG. 1 is a top plan view of a retaining ring pliers having a switching mechanism embodying the present invention.
Figure 2:
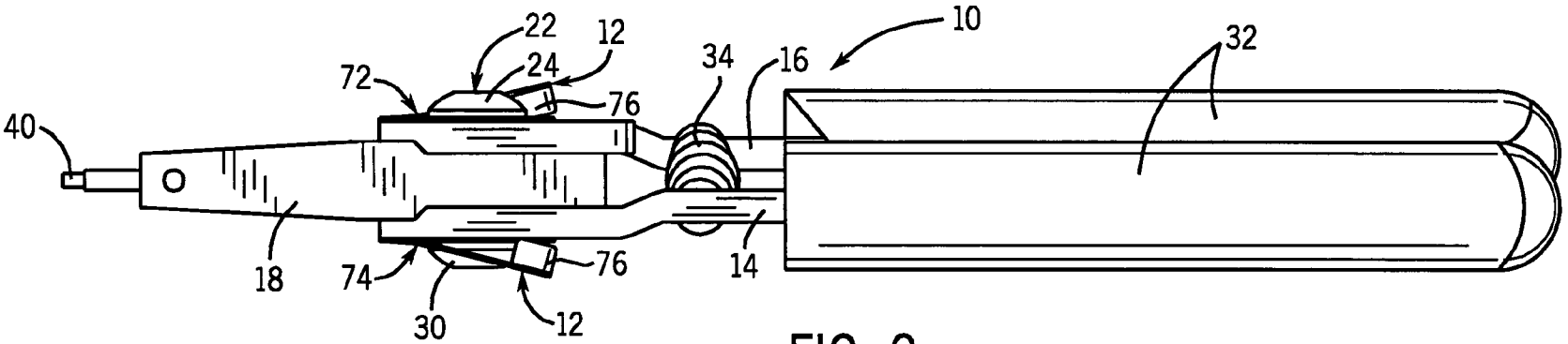
FIG. 2 is a side elevational view thereof.
Figure 3:
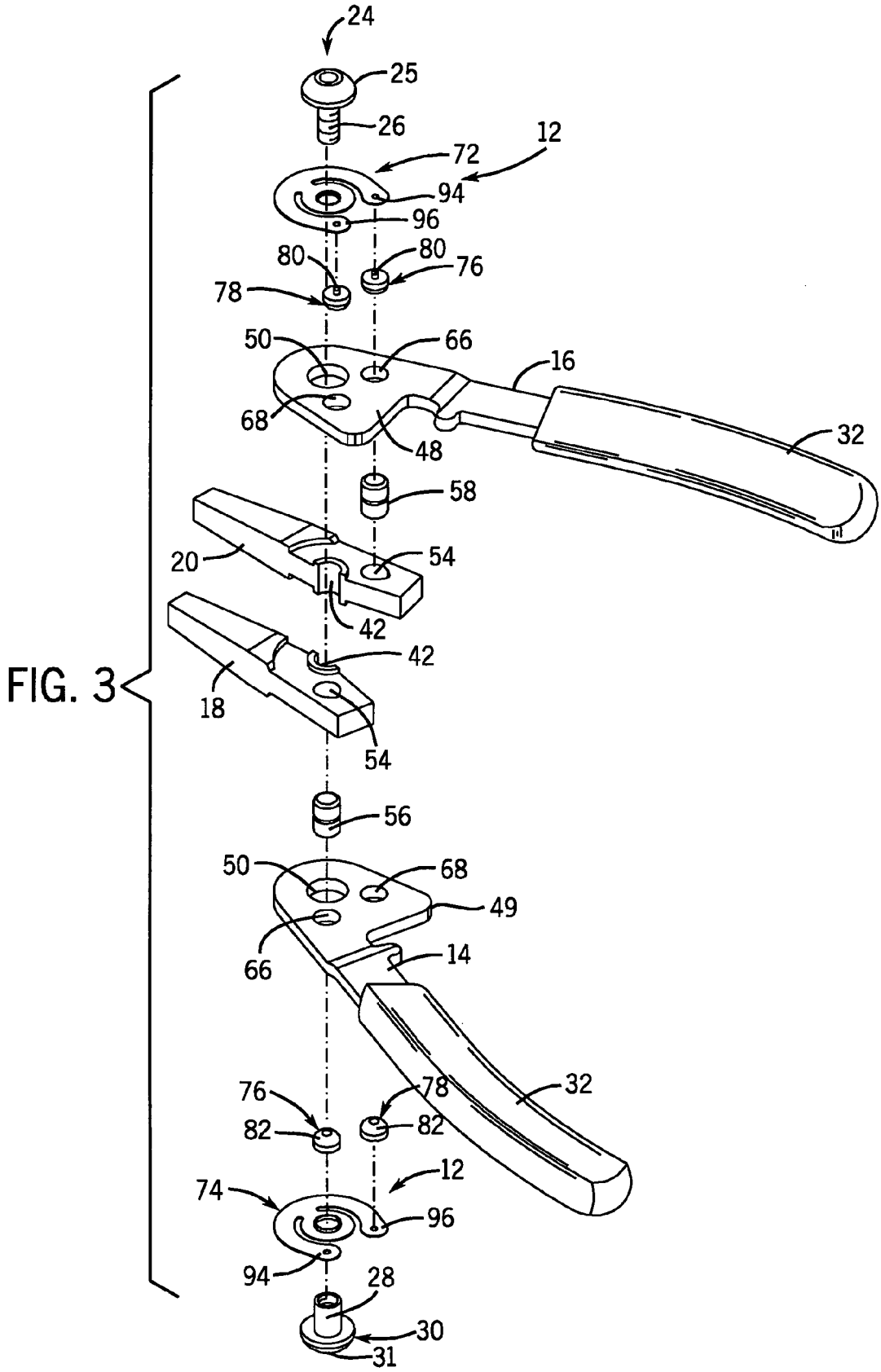
FIG. 3 is an exploded view of FIG. 1.

Referring now to FIGS. 1–3 of the drawings, thereshown is a convertible retaining ring pliers 10 provided with a switching mechanism 12 employing the present invention. The pliers 10 is generally comprised of a pair of handles 14, 16, a pair of elongated jaws 18, 20, and a pivot pin 22. The pivot pin 22 is preferably formed by a screw 24 having a head 25 and a threaded shaft 26 which is threadably received in a barrel 28 of a nut 30 with a head 31. The handles 14, 16 include grips 32 that provide covering to the handles which are generally manufactured of a hard metal. The handles 14, 16 are urged apart by a spring 34 disposed between two opposed lugs 36, 38 on the interior sides of both handles 14, 16. In the retaining ring pliers 10 described, the jaws 18, 20 are designed for mounting of work implements in the form of elongated retaining ring tips 40 having operator posts at the distal ends to be received in the lug holes of standard retaining rings.

Figure 4:
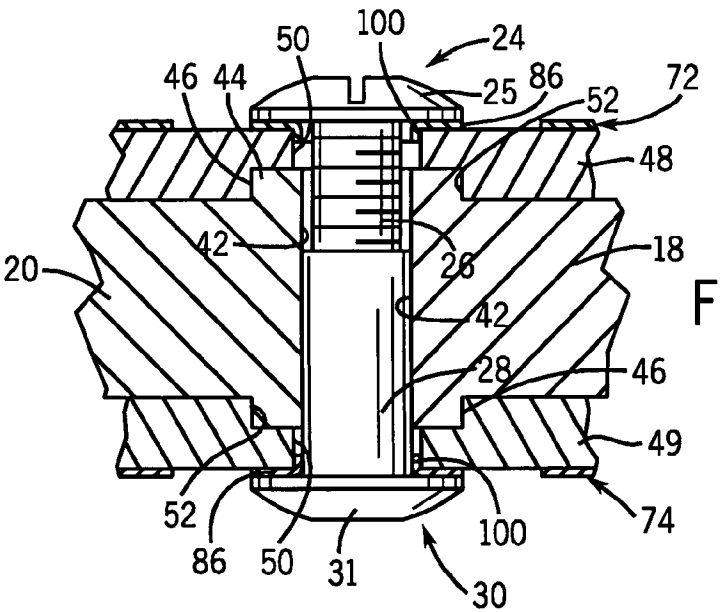
FIG. 4 is a sectional view taken on line 4—4 of FIG. 1.

As best seen in FIGS. 1, 3 and 4, the jaws 18, 20 are disposed in side by side relation and have transverse, cylindrically concave bearing recesses 42 for bearing engagement with a cylindrical portion of pivot pin 22. At its opposite faces, each jaw 18, 20 is provided with a projecting semicircular flange 44 which provides an external bearing shoulder 46 concentric with its bearing recess 42.

The handles 14 and 16 may be fabricated from suitable plate material, such as steel and are enlarged at the opposite ends thereof to define end plates 48, 49 which are disposed parallel to each other to partially confine the jaws 18 and 20 and to enclose other components of the pliers 10 to be described.

The handle end plates 48, 49 are provided with transverse bores 50 to pass the pivot pin 22, and are also provided with recesses concentric with the bores 50 and providing internal cylindrical bearing shoulders 52 for coaction with the bearing shoulders 46 of the jaws 18, 20. Through coaction then of the pivot pin 22 and the bearing shoulders 46 and 52, both jaws 18, 20 and both handles 14, 16 are mounted for rotation about a common defined axis. These principal components are maintained in the operative relation by the pivot pin 22.

Figure 7:
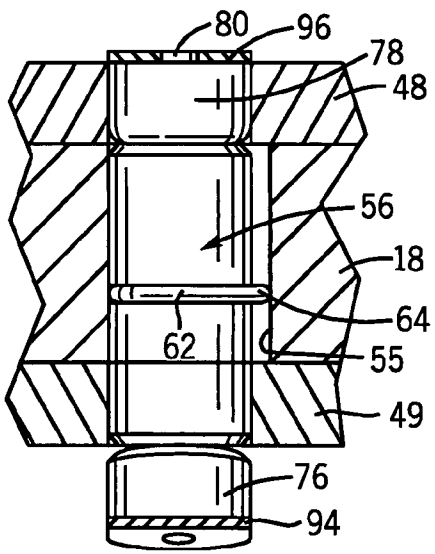
FIG. 7 is a sectional view taken on line 7—7 of FIG. 1.
Figure 5:
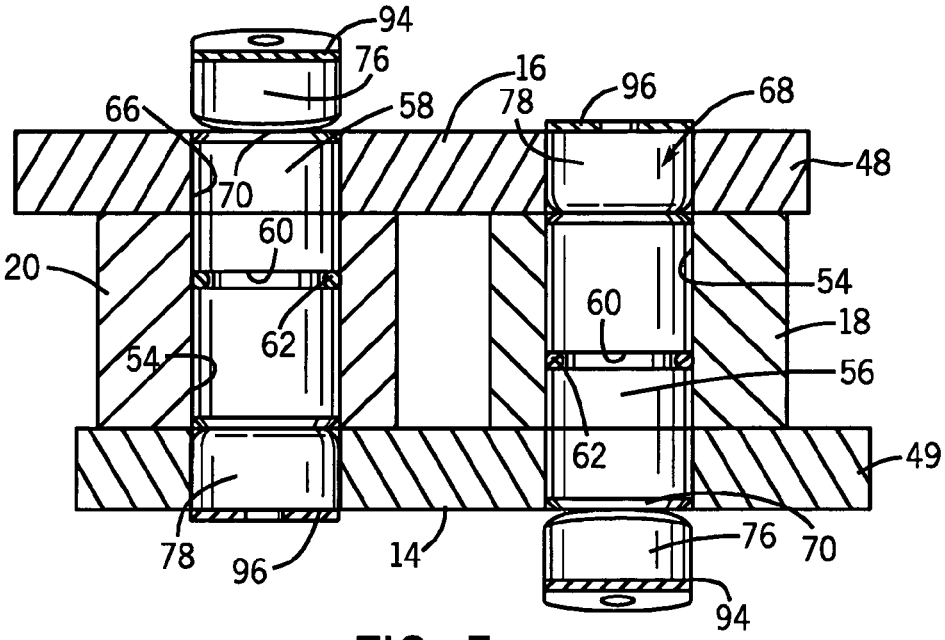
FIG. 5 is a sectional view taken on line 5—5 of FIG. 1 showing the transfer pins in one position.
Figure 6:
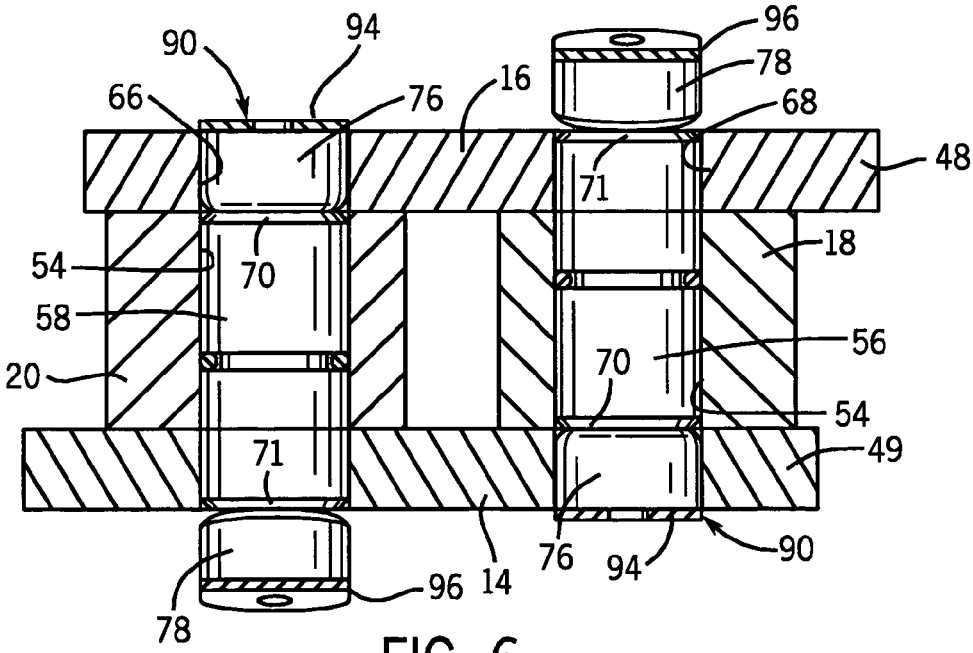
FIG. 6 is a sectional view like FIG. 5 showing the transfer pins in an alternate position.
Figure 8:
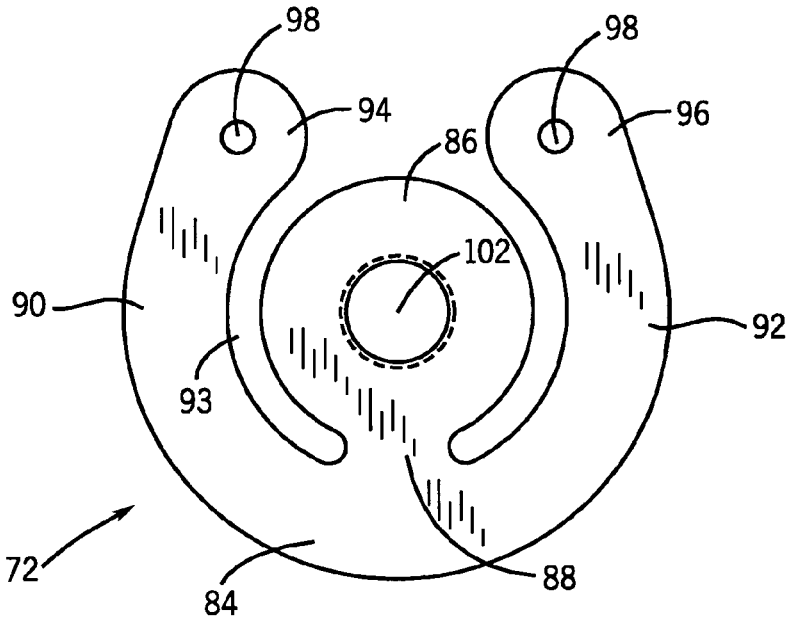
FIG. 8 is a top plan view of a spring used in the switching mechanism.
Figure 9:
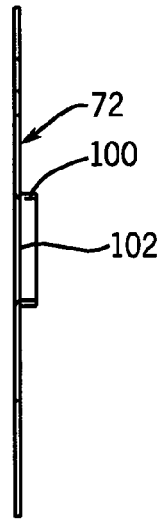
FIG. 9 is a side view of the spring of FIG. 8.
Figure 10:
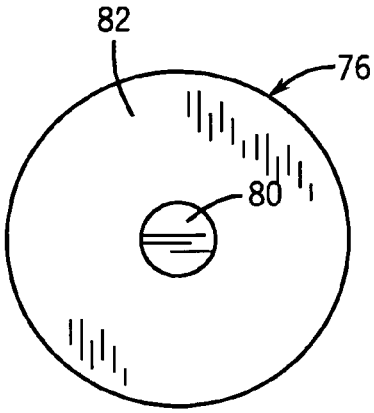
FIG. 10 is a top plan view of a switch boss pin of the switching mechanism.
Figure 11:
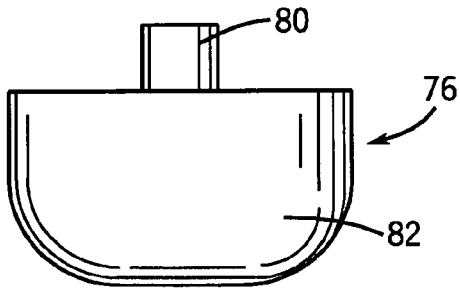
FIG. 11 is a front view of the switch boss pin of FIG. 10.

To effect the convertability of the pliers 10, means are provided for coupling each of the jaws 18, 20 alternatively to one or the other of the two handles 14, 16. In this manner, the jaw 18, 20 is operatively linked to one or the other of the handles 14, 16 for oscillation therewith about the pivot 22. To accomplish this, each jaw 18, 20 is provided at its inner end with a transverse bore 54 (FIG. 5) spaced from and parallel to its respective bearing recess 42. This bore 54 is cylindrical except that it is provided, at one side, with an elongated recess or groove 55, best seen in FIG. 7, which is coextensive with the bore 54. Elongated cylindrical transfer pins 56 and 58 are disposed in these bores 54 and are dimensioned for a close sliding fit within the bores, as best seen in FIGS. 5 and 6. Each transfer pin 56, 58 is provided with an external annular groove 60 equidistant between its ends, dimensioned to receive a retaining device such as a control spring 62. The control spring 62 is a generally C-shaped wire spring having a tangential tab 64 (FIG. 7), and is formed with a free diameter larger than that of a bore 54 so that the spring 62 when confined in transfer pin annular groove 60 will expand into frictional engagement with the bore walls 54. The control spring tab 64 is configured to extend into the longitudinal recess 55 providing a control function to be described.

The handle end plates 48, 49 are each provided with a pair of transverse bores 66 and 68 spaced from each other and from the pivot pin bore 50 and disposed to be axially aligned with respective bores 54 of the jaws 18, 20 in selected relative position. These handle bores 66, 68 have the same diameter as the bores 54 of the jaws 18, 20 so that when a transfer pin 56, 58 is received within a handle bore 66, 68, that handle 14, 16 is securely coupled to the respective jaw 18, 20. As best seen in FIGS. 5 and 6, the transfer pins have a length such that when a pin is fully confined within a jaw bore 54 it has an outermost end 70 which is flush with the external face of the handle end plate 48 or 49. In assembled relation of the pliers 10, it will be seen that the handle end plates 48, 49 are continguous to the opposite faces of the jaws 18, 20 and maintained in that relation by the pivot pin assembly 22, and it will be seen that the transfer pins 56, 58 are confined within the assembly by the coaction of the control spring tabs 64 within the recesses 55 of the jaw bores 54.

Referring now to FIGS. 3, and 8–13, the switching mechanism 12 is comprised of a pair of identical, planar, resilient switches 72, 74, each of which is provided with a pair of identical boss pins 76, 78. In the preferred embodiment switch 72 is mounted on handle plate 48, and switch 74 is installed on handle plate 49. The boss pins 76, 78 have short stems 80 extending perpendicularly from the bottom of radiused heads 82 that are engageable with the outermost ends 70 of the transfer pins 56, 58 and the walls of handle bores 66, 68. Each switch 72, 74 is a wafer-thin plate fabricated of spring steel having an external arcuate or horseshoe-shaped portion 84 integrally connected with an internal, circular anchoring portion 86. With the exception of a connecting segment 88, the external portion 84 includes a pair of curved arms 90, 92 which are spaced apart by a gap 93 from the internal portion 86. Each curved arm 90 or 92 is shaped so that a portion of the external periphery will follow the contour of underlying handle end plate 48, 49. Each arm 90, 92 terminates in an end 94, 96 formed with a similarly sized throughhole 98 for receiving and retaining the short stem 80 of one of the boss pins 76, 78. The internal portion 86 of each switch 72, 74 is formed with a circular neck 100 having a hole 102. As seen in FIG. 4, each neck 100 is recessed in a respective handle plate bore 50, and each hole 102 is aligned with jaw recess 42 so that the pivot pin 22 may pass therethrough. The internal portion 86 of the switch 72 is anchored between a head 25 of screw 24 and an external face of handle end plate 48. The internal portion 86 of switch 74 is fixed between a head 31 of nut 30 and an external face of opposed handle end plate 49.

As will be better appreciated below, each switch 72, 74 has a thin spring steel structure which effectively enables each arm 90 or 92 to temporarily deform and bend about a fulcrum point generally defined by the connecting segment 88 relative to the other arm 92 or 90.

As will now be described through the coaction of the switching mechanism 12, the pivot assembly 22 and the transfer pins 56, 58, each jaw 18 or 20 may be selectively and rigidly linked or coupled to a selected handle 14 or 16.

Figure 12:
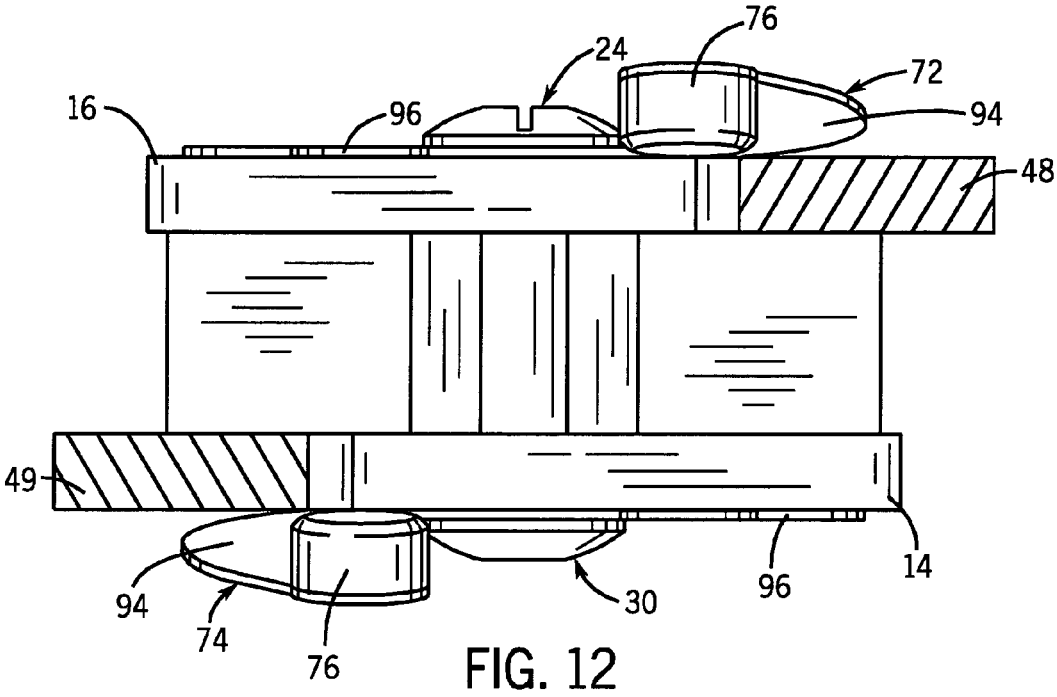
FIG. 12 is a sectional view taken on line 12—12 of FIG. 1 showing an external ring mode.
Figure 13:
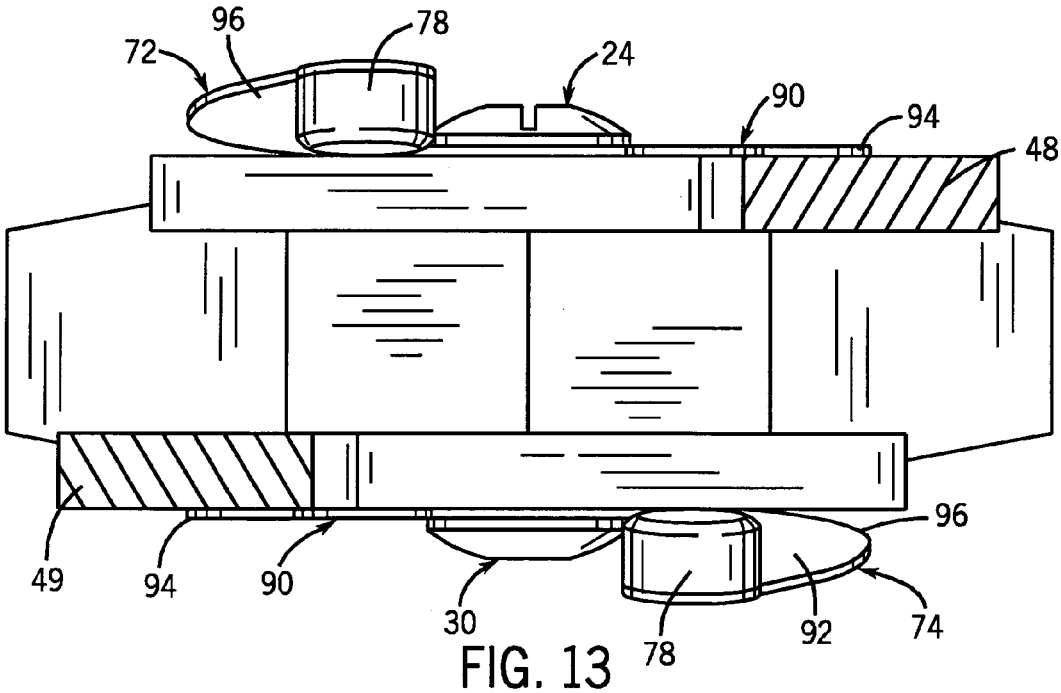
FIG. 13 is a sectional view like FIG. 12 showing an internal ring mode.

The described convertible retaining ring plier 10 is adapted for two operational modes which may be referred to as "the external ring mode" and the "internal ring mode". FIGS. 1, 5 and 12 particularly illustrate the external ring mode. In this mode, the jaw 18 is coupled to the handle 14 and the jaw 20 is coupled to the handle 16 so that squeezing of the handles towards each other will result in corresponding divergence of the jaws away from each other. To effect this coupling, the pins 56, 58 are positioned as illustrated in FIG. 5, and it will be seen that the pin 58 has its end 70 flush with upper handle end plate 48 as viewed in this figure and in FIGS. 1 and 2, and that the transfer pin 56 has its end 70 flush with handle end plate 49.

It will also be seen that the boss pins 76 on the ends 94 of curved arms 90 of switches 72, 74 lie upon the ends 70 of the transfer pins 56, 58 and protrude from the handle end plate bores 66. By virtue of their spring construction, the ends 94 and lower portions of curved arms 90 are temporarily bent upwardly. The other boss pins 78 on the switches 72, 74 are fully confined in bores 68 so that ends 96 of curved arms 92 lie flush on handle end plates 48, 49. Switches 72 and 74 are designed to hold boss pins 76, 78 in alignment with handle end plate bores 66, 68.

When it is desired to move from the external ring mode or position to the internal ring mode or position, the user places their right hand thumb upon the end 94 of switch 72 and their left hand forefinger on the end 94 of the other switch 74. Then, gently squeezing the handles 14, 16 inwardly, equal finger pressure is applied to the raised spring ends 94 and protruding boss pins 76 on both sides of the pliers 10. When the transfer pins 56, 58 are aligned with the respective bores 68 in handles 14, 16 and the boss pins 78 in those bores, the finger pressure will simultaneously push the transfer pins 56, 58 through jaw bores 54 such that transfer pin 58 disengages the handle end plate 48 and transfer pin 56 engages the handle end plate 48. In this position shown in FIG. 6, boss pins 78 on ends 96 of curved arms 92 lie upon the ends 71 of transfer pins 56, 58 and protrude from handle end plates 48, 49 with a portion of the curved arms 92 bent temporarily upward. Boss pins 76 on ends 94 of curved arms 90 are recessed in handle bores 66 and rest on the ends 70 of transfer pins 56, 58 with curved arms 90 lying flat on each handle plate 48, 49.

Referring now to FIGS. 1 and 3, a legend "EXT" is imprinted on the end plate 48 of the handle 16 adjacent to the bore 66 which is positioned to receive the transfer pin 58, and that the legend "INT" is placed on the end plate 48 adjacent to the bore 68 which is positioned to receive the transfer pin 56. In the external mode then, the projecting boss pin 76 at the bore bearing the legend "EXT" informs the user that the pliers 10 is in the "external ring mode". Similarly, when the pliers 10 is in the "internal ring mode" the boss pin 78 will be projecting and provide that indication to the user.

The internal ring mode of the retaining ring pliers 10 is particularly illustrated in FIG. 6. For this mode, the transfer pin 56 of the jaw 18 is now engaged with the handle 16, and the transfer pin 58 of the jaw 20 is now engaged with the handle 14.

It should now be appreciated that the switching mechanism 12 performs two functions incidental to the operation of pliers 10. One function is that the protruding boss pins 76, 78 coacting with a legend provided on the external handle surface provides a visual indication of the operating mode or position of the pliers 10. Another function is the convenience of shifting the transfer pins 56, 58 to convert the pliers 10 to an alternative operational mode. During that shifting, the transfer pins 56, 58 are readily and simultaneously moved without need for an additional implement into their desired positions by applying finger pressure to the boss pins 76, 78 on the switches 72, 74. The switches 72, 74 are made of spring steel and are intended to flex or deform to allow the boss pins 76, 78 to be pushed out of their respective handle bores 66, 68. The switches 72, 74 also function to hold the boss pins 76, 78 in alignment with the bores 66, 68 depending upon the desired position of the pliers 10.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. In a pliers comprising means defining a pivot means, first and second jaws arranged for oscillation toward and away from each other about the pivot means, first and second handles arranged for oscillation toward and away from each other about the pivot means, the handles having portions adjacent to the pivot means disposed on respective opposite sides of the jaws, a transfer pin slidably disposed in each jaw for alternative engagement with one or the other of the handle portions, the transfer pins being disposed in transverse bores of the jaws having axes parallel to the axis of the pivot means, each of the handle portions having a pair of spaced holes disposed to receive the transfer pins, the transfer pins in the first and second jaws being selectively slidably engaged in the holes of respective first and second handles to effect movement of the jaws towards each other when the handles are moved towards each other to define a first operating position, and the transfer pins in the first and second jaws being selectively engaged in the holes of respective second and first handles to effect movement of the jaws away from each other as the handles are moved towards each other to define a second operating position, the improvement comprising:

a switching mechanism mounted to the pivot means and in contact with external surfaces of the handle portions and the transfer pins for enabling simultaneous shifting of the transfer pins in the first and second jaws and holes of the first and second handles, the switching mechanism including a first flexing spring plate disposed on the external surface of one handle portion and a second flexing spring plate disposed on the external surface of the other handle portion, each of the spring plates having a pair of boss pins engageable with opposite ends of the transfer pins.

2. The improvement of claim 1, wherein each spring plate has an external, arcuate-shaped portion integrally joined by a connecting segment to an internal, circular anchoring portion.

3. The improvement of claim 2, wherein the external portion, the connecting segment and the internal portion are all substantially coplanar.

4. The improvement of claim 2, wherein the external portion has a pair of curved arms held spaced apart from the internal portion.

5. The improvement of claim 4, wherein an outer end of each curved arm is provided with one of the boss pins.

6. The improvement of claim 2, wherein the internal portion of the first spring plate is anchored to one end of the pivot means, and the internal portion of the second spring plate is joined to an opposite end of the pivot means.

7. The improvement of claim 4, wherein, in each spring plate, each curved arm is temporarily deformable about a fulcrum point defined by the connecting segment.

8. The improvement of claim 1, wherein, for a given operating position, one pair of corresponding boss pins on the first and second spring plates lie raised above the external surfaces of the handle portions, and another pair of corresponding boss pins lie recessed in holes of the first and second handles.

9. The improvement of claim 1, wherein each boss pin lies between an underside of one of the curved arms and an outermost end of one of the transfer pins.

10. The improvement of claim 4, wherein, in each operating position, one of the curved arms of each spring plate lies flush against the external surface of one of the handles, and the other of the curved arms of the spring plate is temporarily bent upwardly relative to the external surface of the handle.

11. A convertible retaining ring pliers comprising:

a pivot;

first and second jaws rotatably joined about the pivot;

first and second handles rotatably secured about the pivot;

a pair of transfer pins slidably disposed for selective movement in the first and second jaws and first and second handles for establishing a first operating position enabling the jaws to move inwardly as the handles move inwardly, and a second operating position allowing the jaws to move outwardly as the handles move inwardly; and a switching mechanism mounted to the handles and pivot for providing simultaneous shifting of the transfer pins in the jaws and the handles between the first and second operating positions, the switching mechanism including a first flexing spring plate mounted to one end of the pivot and disposed on an external surface of the first handle, and a second flexing spring plate mounted to an opposite end of the pivot and disposed on an external surface of the second handle, each of the spring plates having a pair of boss pins engageable with opposite ends of the transfer pins, whereby, in each operating position, one pair of corresponding boss pins on the first and second spring plates lie raised above the external surfaces of the handles, and another pair of corresponding boss pins lie recessed in the first and second handles.

12. A method of converting a retaining ring pliers having a pivot, first and second jaws rotatably secured about the pivot, first and second handles rotatably joined about the pivot, and a pair of transfer pins slidably disposed for selective movement in the first and second jaws and the first and second handles between one operating position enabling the jaws to move inwardly as the handles move inwardly, and a second operating position enabling the jaws to move outwardly as the handles move inwardly, the method comprising the steps of:

mounting a first flexing spring plate having a first pair of boss pins at opposite ends thereof to one end of the pivot such that the first spring plate is disposed on an external surface of the first handle and the first pair of boss pins are engageable with opposite ends of the transfer pins; and mounting a second flexing spring plate having a second pair of boss pins at opposite ends thereof to an opposite end of the pivot such that the second spring plate is disposed on an external surface of the second handle and the second pair of boss pins are engageable with the opposite ends of the transfer pins, wherein, in each operating position, one pair of corresponding boss pins on the first and second spring plates lie raised above the external surface of the handles, and another pair of corresponding boss pins lie recessed in the first and second handles, and whereby finger pressure is applied to ends of the spring plates carrying the raised boss pins to simultaneously shift the transfer pins between the first and second operating positions.

* * * * *